US005819443A

United States Patent [19]

Winter

[11] Patent Number: 5,819,443

[45] Date of Patent: Oct. 13, 1998

[54] SNOW REMOVAL APPARATUS

[76] Inventor: William L. Winter, 189 Peekskill Holow Rd., Putnam Valley, N.Y. 10579

[21] Appl. No.: 906,113

[22] Filed: Jul. 25, 1997

[51] Int. Cl.[6] ..... E01H 5/04

[52] U.S. Cl. ..... 37/233; 37/232; 37/266; 172/766

[58] Field of Search ..... 37/266, 268, 241, 37/233, 232, 231, 407, 446, 460; 56/400.01, 400.17, 400.21, 400.04, 400.19; 172/684.5, 765, 766

[56] References Cited

U.S. PATENT DOCUMENTS

| | | | |
|---|---|---|---|
| 520,479 | 5/1894 | Bunnell | 37/233 X |
| 2,061,585 | 11/1936 | Meyer | 37/233 |
| 2,080,129 | 5/1937 | Gulotta | 37/233 X |
| 2,936,537 | 5/1960 | Bain | 37/233 |
| 3,921,726 | 11/1975 | Connor et al. | 172/741 X |
| 4,452,320 | 6/1984 | Meiners | 172/763 X |
| 4,570,366 | 2/1986 | Yost | 37/232 |
| 4,709,492 | 12/1987 | Watson | 37/232 |
| 5,140,763 | 8/1992 | Nichols, IV | 37/233 |
| 5,142,855 | 9/1992 | Guidarelli | 56/400.04 X |
| 5,471,770 | 12/1995 | Ferreira | 37/233 X |
| 5,497,569 | 3/1996 | Byman | 37/233 X |

*Primary Examiner*—Tamara L. Graysay
*Assistant Examiner*—Thomas A. Beach

[57] ABSTRACT

A new snow removal apparatus for removing snow and other debris from travel surfaces. The inventive device includes an elongate frame member with a plurality of overlapping finger members extending from the frame member. The frame member is designed to be coupled to a vehicle or a mounting frame of a snowplow. The finger members are designed to adjust to an uneven surface to remove snow or debris therefrom.

12 Claims, 3 Drawing Sheets

24
21
25
22
20
26

1
2
3
10
20
30
4
5
6
7

SNOW REMOVAL APPARATUS

BACKGROUND OF THE INVENTION

1. Field of the Invention

The present invention relates to apparatus for removing snow and more particularly pertains to a new snow removal apparatus for removing snow and other debris from travel surfaces.

2. Description of the Prior Art

The use of apparatus for removing snow is known in the prior art. More specifically, apparatus for removing snow heretofore devised and utilized are known to consist basically of familiar, expected and obvious structural configurations, notwithstanding the myriad of designs encompassed by the crowded prior art which have been developed for the fulfillment of countless objectives and requirements.

Known prior art apparatus for removing snow include U.S. Pat. No. 5,140,763; U.S. Pat. No. 4,669,205; U.S. Pat. No. 4,843,744; U.S. Pat. No. 4,843,744; U.S. Pat. No. 4,671,363; and U.S. Pat. No. Des. 310,225.

While these devices fulfill their respective, particular objectives and requirements, the aforementioned patents do not disclose a new snow removal apparatus. The inventive device includes comprises an elongate frame member with a plurality of overlapping finger members extending from the frame member.

In these respects, the snow removal apparatus according to the present invention substantially departs from the conventional concepts and designs of the prior art, and in so doing provides an apparatus primarily developed for the purpose of removing snow and other debris from travel surfaces.

SUMMARY OF THE INVENTION

In view of the foregoing disadvantages inherent in the known types of apparatus for removing snow now present in the prior art, the present invention provides a new snow removal apparatus construction wherein the same can be utilized for removing snow and other debris from travel surfaces.

The general purpose of the present invention, which will be described subsequently in greater detail, is to provide a new snow removal apparatus apparatus and method which has many of the advantages of the apparatus for removing snow mentioned heretofore and many novel features that result in a new snow removal apparatus which is not anticipated, rendered obvious, suggested, or even implied by any of the prior art apparatus for removing snow, either alone or in any combination thereof.

To attain this, the present invention generally comprises comprises an elongate frame member with a plurality of overlapping finger members extending from the frame member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new snow removal apparatus apparatus and method which has many of the advantages of the apparatus for removing snow mentioned heretofore and many novel features that result in a new snow removal apparatus which is not anticipated, rendered obvious, suggested, or even implied by any of the prior art apparatus for removing snow, either alone or in any combination thereof.

It is another object of the present invention to provide a new snow removal apparatus which may be easily and efficiently manufactured and marketed.

It is a further object of the present invention to provide a new snow removal apparatus which is of a durable and reliable construction.

An even further object of the present invention is to provide a new snow removal apparatus which is susceptible of a low cost of manufacture with regard to both materials and labor, and which accordingly is then susceptible of low prices of sale to the consuming public, thereby making such snow removal apparatus economically available to the buying public.

Still yet another object of the present invention is to provide a new snow removal apparatus which provides in the apparatuses and methods of the prior art some of the advantages thereof, while simultaneously overcoming some of the disadvantages normally associated therewith.

Still another object of the present invention is to provide a new snow removal apparatus for removing snow and other debris from travel surfaces irregularities in contour.

Yet another object of the present invention is to provide a new snow removal apparatus which includes an elongate frame member with a plurality of overlapping finger members extending from the frame member.

Still yet another object of the present invention is to provide a new snow removal apparatus that adjusts to the contours of a surface to remove snow and debris therefrom.

Even still another object of the present invention is to provide a new snow removal apparatus that has fingers overlapping to help direct collected debris towards the side of the traveling surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
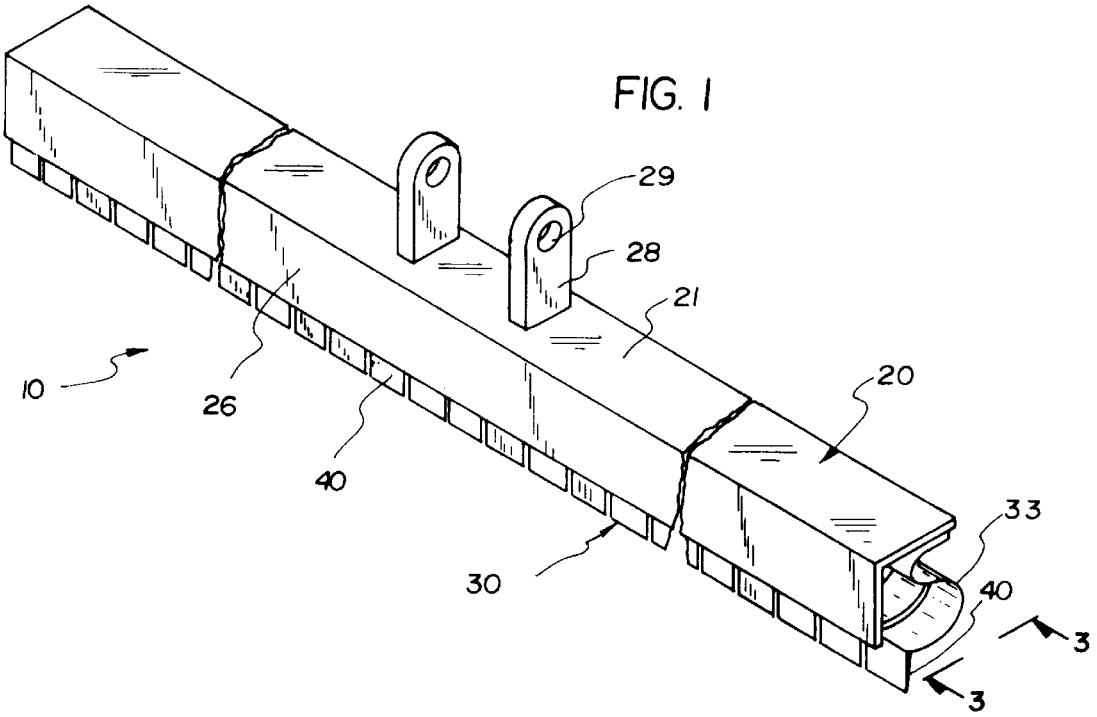
FIG. 1 is a perspective view of a new snow removal apparatus according to the present invention.
Figure 2:
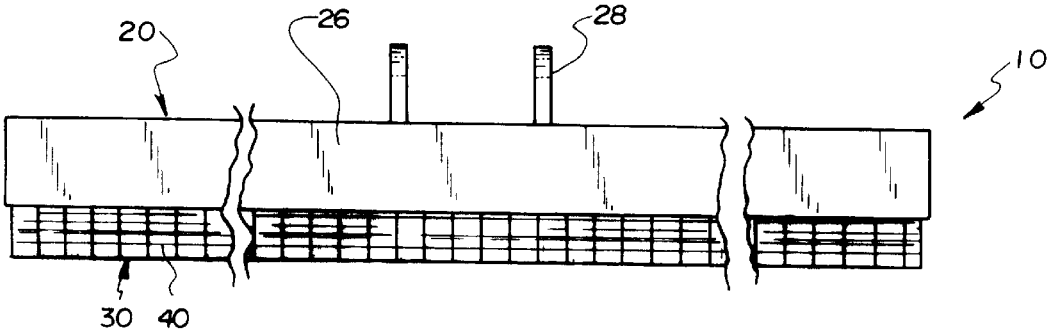
FIG. 2 is a front side view of the present invention.

With reference now to the drawings, and in particular to FIGS. 1 through 6 thereof, a new snow removal apparatus embodying the principles and concepts of the present invention and generally designated by the reference numeral 10 will be described.

As best illustrated in FIGS. 1 through 6, the snow removal apparatus 10 comprises an elongate frame member 20 with a plurality of overlapping finger members 30 extending from the frame member 20.

The frame member 20, as shown in FIG. 1, has a mounting portion 21 and a shielding portion 26. The shielding portion downwardly extends from the mounting portion 21. Preferably, the shielding portion 26 is positioned towards the front end 22 of the mounting portion 21. Ideally, the shielding portion 26 is extended substantially perpendicular from the mounting portion 21.

The frame member 20 is designed to be coupled to a vehicle 1 or a mounting frame 3 of a snowplow 2 by a mounting means 28. In a preferred embodiment, as shown in FIG. 1, the mounting means 28 is a pair of spaced apart mounting ears 28 extending from the upper surface 24 of the mounting portion 21. Each mounting ear 28 has a mounting hole 29 to permit mounting to the frame member 20 to a vehicle 1 or a mounting frame 3.

Figure 4:
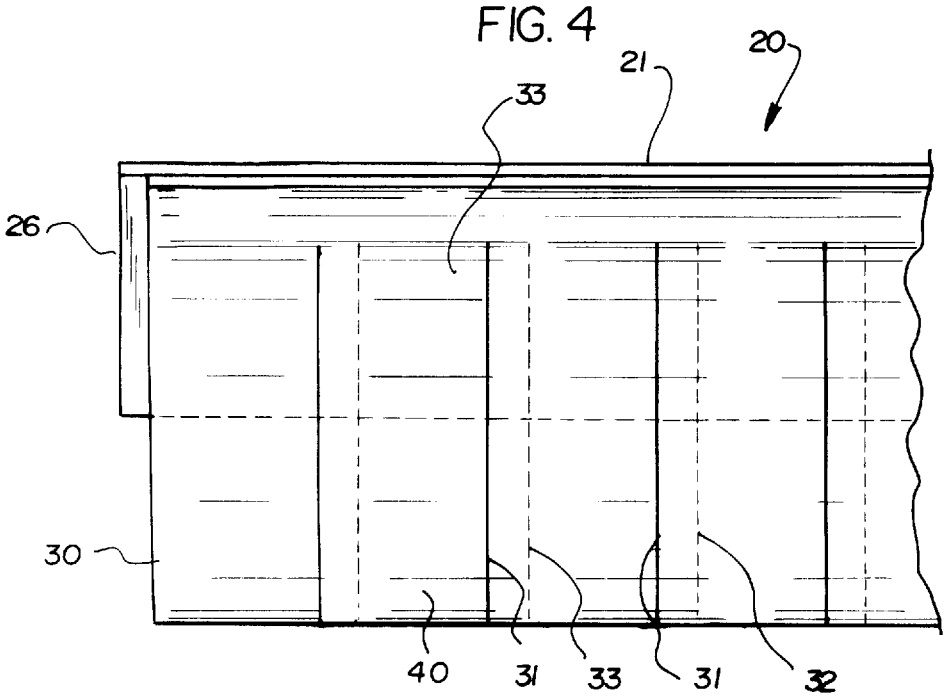
FIG. 4 is a partialrear side view of the present invention showing the overlapping finger members.

A plurality of finger members 30 extend between the frame member 20. The finger members 30 are extended substantially perpendicular from the frame member 20 and arranged along the length of the frame member 20. Each finger member 30 has a first side region 31 and a second side region 32. As shown in FIG. 4, the first side region 31 of each finger member 30 overlaps the second side region 32 of its adjacent finger member 30. The overlapping of th efingers helps direct collected debris towards the side of the traveling surface.

Figure 3:
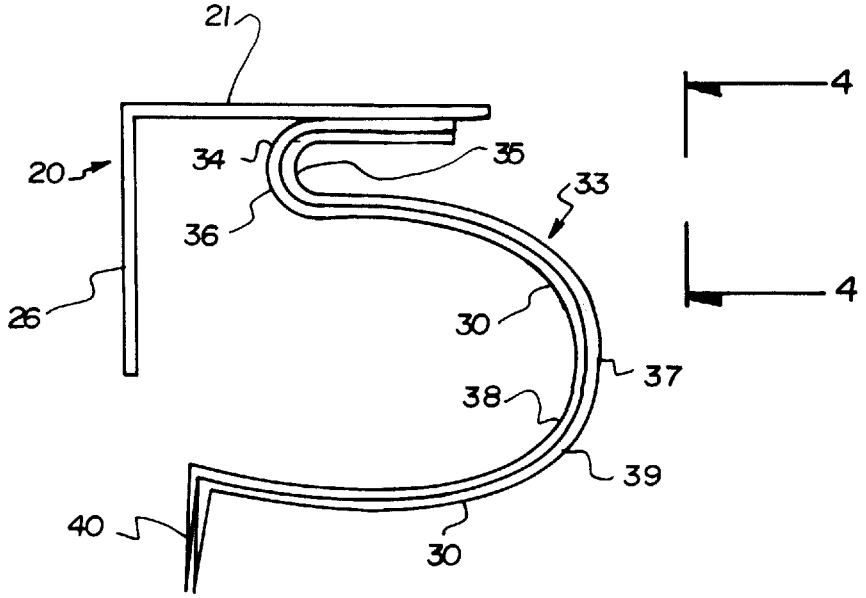
FIG. 3 is a side view of the present invention.

Each of the finger members 30 has a flexing portion 33 and a debris plowing portion 40. The flexing portion 33 is designed to help keep the debris plowing portion engaged to the contours of an uneven surface. Preferably, as shown in FIG. 3, the flexing portion 33 is S-shaped and includes an upper arcuate region 34 and a lower arcuate region 37. The upper arcuate region 34 is coupled to the lower surface 25 of the mounting portion 21 of the frame member 20. Ideally, the finger members 30 are constructed from a metal, such as steel, aluminum, or tin.

As shown in FIG. 3, the debris plowing portion 40 extends downwardly from the lower arcuate region 37. The debris plowing portion 40 extends below the shielding portion 26 of the frame member 20 in order to engage a surface for removing debris thereon.

Figures 5, 6:
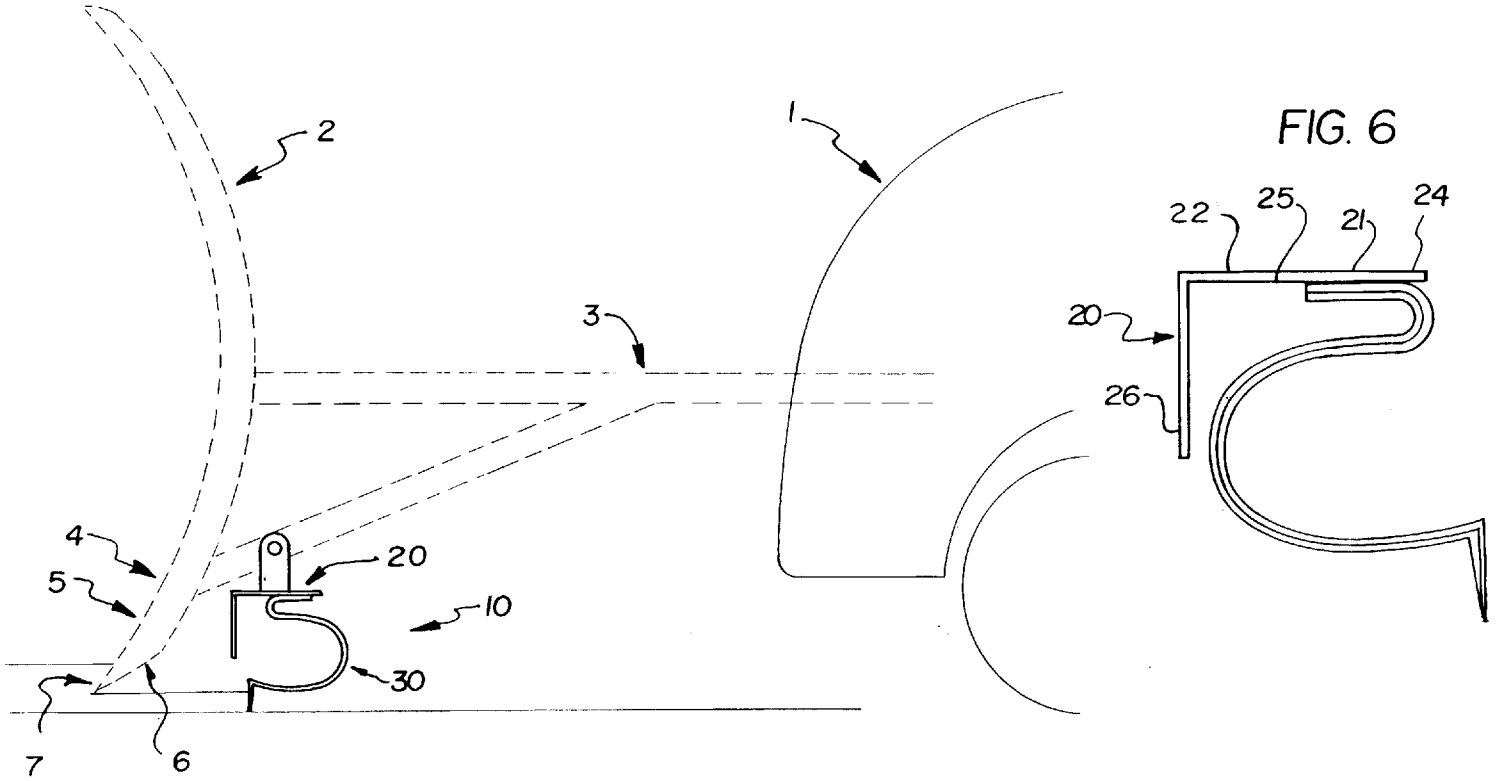
FIG. 5 is a side view of the present invention in use attached to the mounting frame of a snowplow.
FIG. 6 is a side view of an optional embodiment of the present invention with the finger member flexing portion arcuate regions in a different orientation.

Preferably, as shown in FIG. 3, the convex surface 36 of the upper arcuate region 34 and the concave surface 38 of the lower arcuate region 37 face the shielding portion 26 of the frame member 20. In an optional embodiment as shown in FIG. 6, the concave surface 35 of the upper arcuate region 34 and the convex surface 39 of the lower arcuate region 37 faces the shielding portion 26. The optional embodiment has the advantage of helping keep the debris plowing portion 40 engaged to a surface while maintaining the shape of the finger member 30 when the snow removal apparatus 10 is moved across a surface.

In use, the snow removal apparatus 10 is designed for mounting to a vehicle 1. Preferably, the snow removal 10 apparatus is designed for mounting to a snowplow 2 having a mounting frame 3 and a plow blade 4. Ideally, the mounting frame 3 is coupled to the back side 6 of the plow blade 4. The front plowing side 5 of the snow blade 4 has a lower plowing edge 7 to engage the snow on a surface. In this embodiment, the debris plowing portion 40 extends below the lower plowing edge 7 to engage a surface for removing debris thereon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for removing snow, comprising:

an elongate frame member for mounting to a vehicle, said frame member having a mounting portion, a shielding portion, and a pair of opposite ends, said shielding portion being downwardly extended from said mounting portion; and a plurality of overlapping finger members being extended from said frame member, each said finger member having an S-shaped flexing portion and a debris plowing portion, said flexing portion being coupled to said frame member, said debris plowing portion being downwardly extended from said flexing portion, said debris plowing portion being extended below said frame member shielding portion, said debris plowing portion being for engaging a surface for removing debris thereon.

2. The apparatus of claim 1, wherein each said finger member has a first side region, and a second side region, each said finger member first side region overlapping said second side region of the adjacent said finger member.

3. The apparatus of claim 1, wherein said finger members are arranged along the length of said frame member.

4. The apparatus of claim 1, further comprising a mounting means for mounting said frame member to a snowplow of a vehicle.

5. The apparatus of claim 4, wherein said frame member mounting portion has an upper surface, and wherein said mounting means includes a pair of spaced apart mounting ears for mounting to a mounting frame of a snowplow, said mounting ears being extended from said frame member mounting portion upper surface.

6. The apparatus of claim 1, wherein said frame member mounting portion has a front end, said frame member shielding portion being positioned towards said mounting portion front end.

7. The apparatus of claim 1, wherein said frame member mounting portion has a lower surface, and wherein each said finger member flexing portion has an upper arcuate region being coupled to said frame member mounting portion lower surface.

8. The apparatus of claim 1, wherein each said finger member flexing portion has a lower arcuate region, said finger member debris plowing portion being downwardly extended from said flexing portion lower arcuate region.

9. The apparatus of claim 1, wherein said each said finger member flexing portion has an upper arcuate region, and a lower arcuate region, said upper arcuate region having a concave surface and a convex surface, and said lower arcuate region having a concave surface and a convex surface.

10. The apparatus of claim of 9, wherein each said finger member flexing portion upper arcuate region convex surface faces said frame member shielding portion, and wherein each said finger member flexing portion lower arcuate region concave surface faces said frame member shielding portion.

11. The apparatus of claim of 9, wherein each said finger member flexing portion upper arcuate region concave surface faces said frame member shielding portion, and wherein each said finger member flexing portion lower arcuate region convex surface faces said frame member shielding portion.

12. A apparatus for removing snow, said apparatus being for attachment to a snowplow having a plow blade and a mounting frame, said plow blade being coupled to said mounting frame, said mounting frame being for attachment to a vehicle, said plow blade having a front plowing side, a back side, and a lower plowing edge, said apparatus comprising:

an elongate frame member for positioning adjacent a plow blade back side, said frame member having a mounting portion, a shielding portion, and a pair of opposite ends;

said mounting portion having a front end, an upper surface, and a lower surface; and said shielding portion being downwardly extended from said mounting portion, said shielding portion being positioned towards said mounting portion front end;

a pair of spaced apart mounting ears for mounting to a mounting frame of a snowplow, said mounting ears being extended from said frame member mounting portion upper surface; and a plurality of finger members being extended substantially perpendicular from said frame member, said finger members being arranged along the length of said frame member, each said finger member having a first side region, a second side region, a S-shaped flexing portion, and a debris plowing portion, each said finger member first side region overlapping said second side region of the adjacent said finger member;

said S-shaped flexing portion having an upper arcuate region, and a lower arcuate region;

said upper arcuate region having a concave surface and a convex surface, said upper arcuate region being coupled to said frame member mounting portion lower surface, said upper arcuate region convex surface facing said frame member shielding portion;

said lower arcuate region having a concave surface and a convex surface, said lower arcuate region concave surface facing said frame member shielding portion; and said debris plowing portion being downwardly extended from said flexing portion lower arcuate region, said debris plowing portion being extended below said frame member shielding portion, said debris plowing portion being for extending below a lower plowing edge of a primary snowplow apparatus, said debris plowing portion being for engaging a surface for removing debris thereon.

* * * * *